United States Patent [19]

Staehlin et al.

[11] Patent Number: 4,891,651

[45] Date of Patent: Jan. 2, 1990

[54] LIGHT PLANE COMMUNICATION SYSTEM FOR USE IN A PHASED ARRAY ANTENNA

[75] Inventors: John H. Staehlin, Lutherville; John R. Colgan, Lothian, both of Md.

[73] Assignee: Westinghouse Electric Corp., Pittsburgh, Pa.

[21] Appl. No.: 254,016

[22] Filed: Oct. 6, 1988

[51] Int. Cl.[4] ..... H01Q 3/30

[52] U.S. Cl. ..... 343/853; 343/778; 342/372

[58] Field of Search ..... 343/762, 771, 772, 778, 343/786, 850, 853; 342/368, 371, 372

[56] References Cited

U.S. PATENT DOCUMENTS

| | | | |
|---|---|---|---|
| 4,529,986 | 7/1985 | d'Auria et al. | 343/853 |
| 4,583,096 | 4/1986 | Bellman et al. | 342/368 |
| 4,620,193 | 10/1986 | Heeks | 342/368 |
| 4,739,334 | 4/1988 | Soref | 342/368 |
| 4,814,773 | 3/1989 | Wechsberg et al. | 342/368 |

*Primary Examiner*—Rolf Hille

*Assistant Examiner*—Doris J. Johnson

*Attorney, Agent, or Firm*—Joseph C. Spadacene

[57] ABSTRACT

A light plane assembly for use in a phased array antenna to provide a communication link between a phased array antenna control system and the individual phase control modules in the array. The light plane assembly includes a translucent member having a plurality of openings therethrough. Each opening is adapted to receive a phase control module having an optic signal detector mounted thereon. Each module is positioned in an opening so that the optic signal detector on the module lies within the opening. Light emitting diodes in optic communication with an edge surface of the translucent member are connected with a phased array antenna control system and are operable to convert an electrical information signal provided from the control system to an equivalent optic information signal. The light emitting diodes generate an optic information signal which is transmitted through the interior of the translucent member for detection by the optic signal detector on each phase control module.

19 Claims, 3 Drawing Sheets

FIG. 2
PRIOR ART
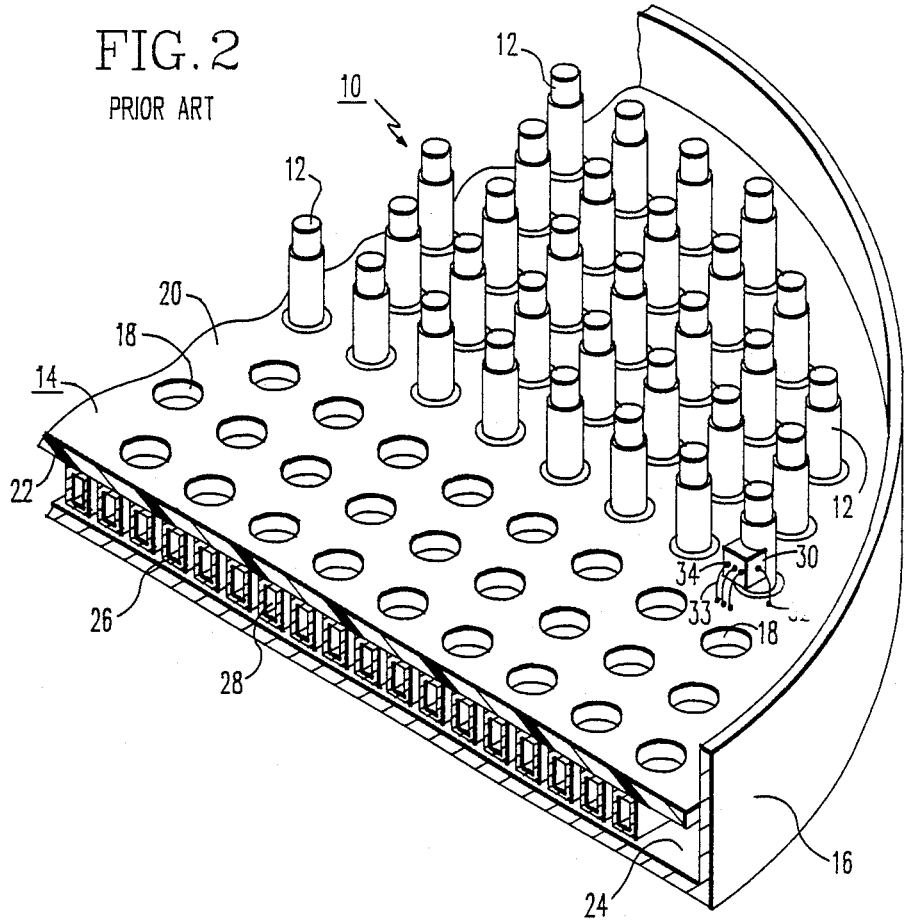
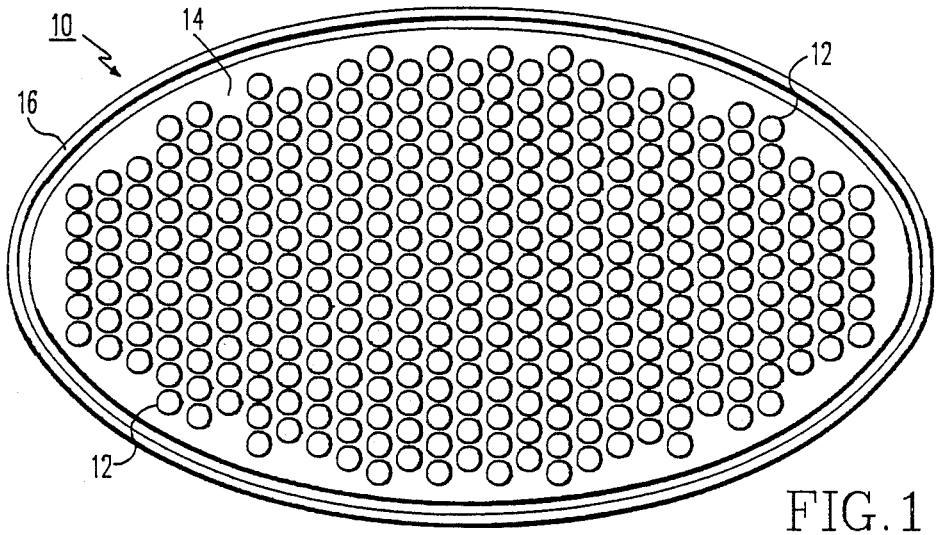
FIG. 1

LIGHT PLANE COMMUNICATION SYSTEM FOR USE IN A PHASED ARRAY ANTENNA

BACKGROUND OF THE INVENTION

1. Field of the Invention

This invention relates generally to phased array antenna systems, and more particularly, to a phased array antenna which includes a light plane assembly for optically coupling the control system of the antenna with the individual phase control modules forming the antenna array.

2. Background Information

Both the construction and operation of conventional phased array antennas are well known. Phased array antennas presently in operation normally include a plurality of individual phase control module and radiator assemblies which are mounted to a printed wiring board positioned in the antenna housing. Electrical connections (e.g., for power/ground, beam update data, row/-column data) between the antenna control system and the individual modules and radiator assemblies mounted to the printed wiring board are made through either a pin/socket or terminal/jumper wire arrangement at the interface between the printed wiring board and the phase control modules. If a pin/socket arrangement is utilized, the pins are connected with each module, and the sockets are assembled to a printed wiring board having typically 14 or 15 separate electrically conductive layers therein that essentially extends over the entire area of the array. Each socket is connected with an individual electrically conductive layer, and electrical information provided from the antenna control system is passed through the conductive layers and sockets to the individual module pins inserted in the sockets. If a terminal/jumper wire arrangement is utilized, terminals are mounted on the printed wiring board and are connected with selected electrically conductive layers embedded in the board. Jumper wires extending between the wiring board terminals and terminals mounted to an individual module are utilized to provide an electrical information transmission path between the antenna control system and the module.

It is readily apparent that the printed wiring board presently utilized to provide an electrical information transmission path between the phased array antenna control system and the individual phase control module and radiator assemblies forming the array must necessarily have an extremely complex construction, resulting in increased antenna manufacturing costs. In addition, this flow path which consists of discrete printed wiring board circuit layers and pin/socket or terminal/-jumper wire connections forms an essentially hard-wired link between the antenna control system and the modules in the array. The detection of circuit faults or improper electrical connections in any hard-wired system requires a substantial amount of maintenance down time which, in this case, would result in an undesired shut-down of the antenna.

Therefore, there is a need for an improved assembly for use in a phased array antenna operable to provide a communication link between the control system of the antenna and the individual phase control module and radiator assemblies forming the antenna array. The improved assembly must provide an optic communication link to eliminate the problems associated with presently utilized hard-wired communication systems. The improved assembly must be of simple construction, and lend itself to easy maintenance and repair. In addition, there is a need for an improved phase control module and radiator assembly which may be used with the optic communication assembly of the present invention.

SUMMARY OF THE INVENTION

In accordance with the present invention, there is provided a light plane assembly for passing an electrical information signal provided from a phased array antenna control system to a plurality of individual phase control modules forming the antenna array which includes a translucent member for placement within a phased array antenna housing. The translucent member has a plurality of openings therethrough, each of the openings adapted to accept at least a portion of a phase control module having optic signal receiving means thereon. Light transmitting means positioned in optic communication with the translucent member is connected with the phased array antenna control system. The light transmitting means is operable to convert an electrical information signal provided from the antenna control system to an equivalent optic information signal. The light transmitting means in optic communication with the translucent member is operable to provide the optic information signal to the translucent member for transmission through an interior portion of the translucent member. The optic information signal transmitted through the translucent member interior portion is received by the phase control module optic signal receiving means for reconversion within the module to an electrical information signal.

Further in accordance with the present invention, there is provided a light plane assembly for passing an electrical information signal provided from a phased array antenna control system to a plurality of individual phase control modules forming the antenna array which includes a translucent member for placement within a phased array antenna housing. The translucent member has a first surface, a second surface opposed to the first surface, an edge surface extending between the first and second surfaces, and a plurality of openings extending through the translucent member from the first to the second surface. Each opening in the translucent member defines a wall portion between the first and second surfaces, and is adapted to accept at least a portion of a phase control module having optic signal receiving means thereon with the optic signal receiving means positioned adjacent the opening wall portion.

Light transmitting means positioned in optic communication with the translucent member edge surface is connected with a phased array antenna assembly control system. The light transmitting means is operable to convert an electrical information signal provided from the control system to an equivalent optic information signal. The light transmitting means provides the optic information signal to the translucent member at the translucent member edge surface for transmission through the translucent member between the first and second surfaces. The optic information signal transmitted through the translucent member is received by each phase control module optic signal receiving means positioned in an opening adjacent an opening wall portion and is reconverted within the module to an electrical information signal.

BRIEF DESCRIPTION OF THE DRAWINGS

The above, as well as other features and advantages of the present invention will become apparent through consideration of the detailed description in connection with the accompanying drawings, in which:

FIG. 1 is a top plan view of a conventional phased array antenna housing having a printed wiring board positioned therein, illustrating a plurality of individual phase control module and radiator assemblies mounted to the printed wiring board;

FIG. 2 is a perspective view of a portion of a conventional phased array antenna, illustrating a plurality of individual phase control module and radiator assemblies secured to a printed wiring board positioned within the antenna housing;

DESCRIPTION OF THE PREFERRED EMBODIMENTS

Figure 3:
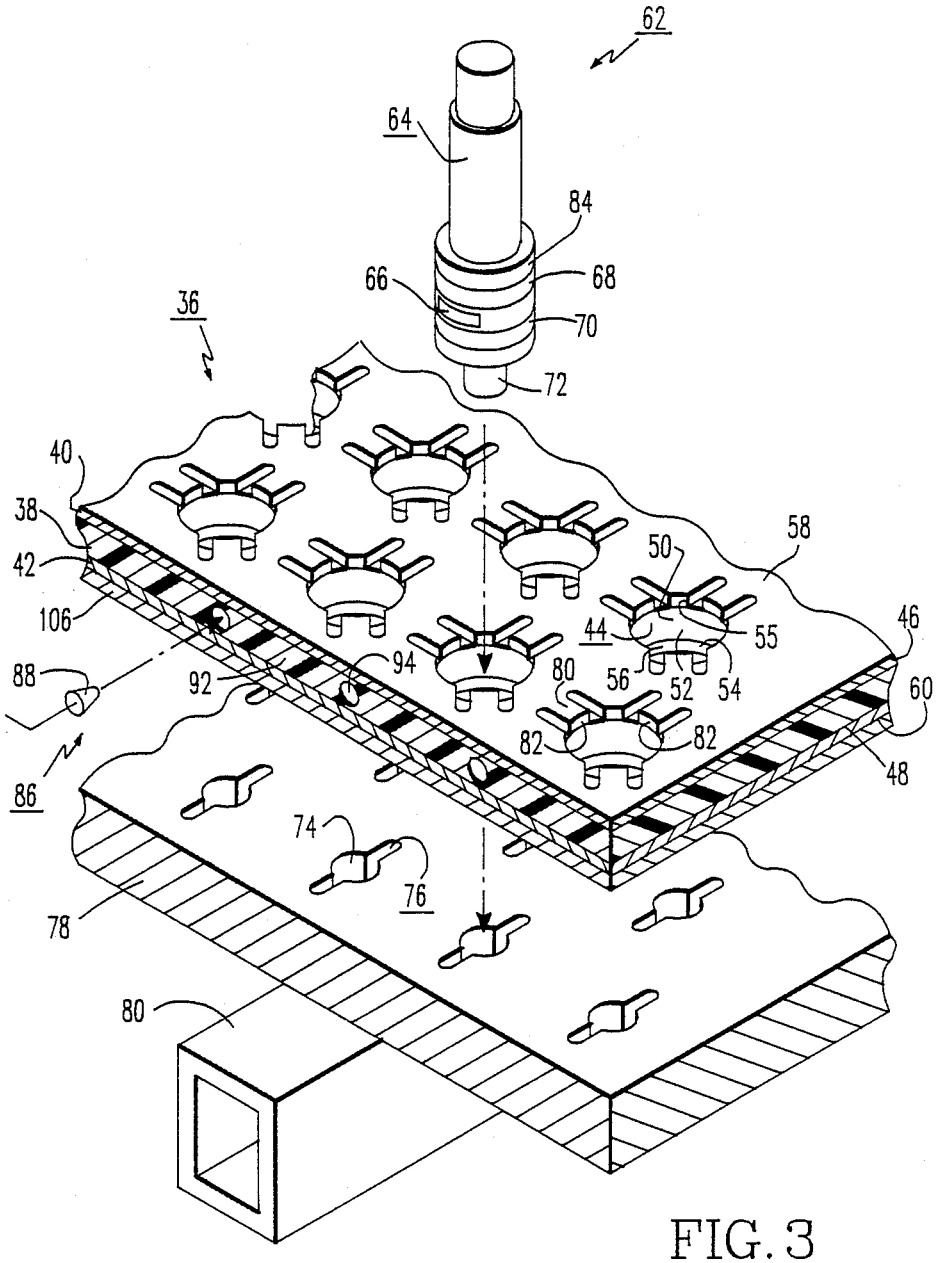
FIG. 3 is an exploded, partial fragmentary view of the light plane assembly of the present invention for use in a phased array antenna.

Referring to the drawings, and particularly to FIG. 1, there is illustrated a schematic representation of a phased array antenna generally designated by the numeral 10. As known in the art, antenna 10 includes a plurality of individual phase control module and radiator assemblies 12, hereinafter referred to as phase control modules, mounted on a printed wiring board 14 which is positioned within an antenna housing 16. Each phase control module is operable to pass either a transmitted or received radar signal therethrough, and the amplitude and phase of a radar signal passed through a particular module is controlled via appropriate signals delivered from an antenna control system (not shown) to the module in order to obtain a desired overall radiation pattern from the combined action of all the modules.

Referring to FIG. 2, there is illustrated in perspective view a portion of the phased array antenna 10 of FIG. 1. Each of the individual phase control modules 12 making up the antenna array is positioned within an opening 18 in printed wiring board 14 which extends completely through the printed wiring board from top surface 20 to bottom surface 22. As previously described, printing wiring board 14 is positioned within antenna housing 16. Each module 12 has an end portion (not shown) which extends beneath the bottom surface 22 of printed wiring board 14 into the hollow interior portion 24 of housing 16. Preselected groups of individual modules 12 are connected in a well known manner with an individual manifold 26. Radar signals either transmitted or received by an individual module 12 in a preselected group of modules are passed through the hollow interior 28 of the manifold 26 which is connected with the modules of the preselected group.

With phased array antennas of the prior art such as illustrated in FIGS. 1 and 2, a printed wiring board such as printed wiring board 14 is utilized to electrically connect the control circuitry internal to the individual phase control modules 12 in the array to a phased array antenna control system (not shown). Stated in another manner, printed wiring board 14 provides a transmission path for electrical information passed between the antenna control system and each module in the array. The information transmission path is formed from a plurality (normally 14 or 15) of discrete, layered electrical circuits which are embedded in the board (circuit layers not shown). Preselected groups of individual modules 12 are connected with a single circuit layer, and information to be provided to each module such as row/column data, radar beam update data, and the module power and ground connections are supplied from the phased array antenna control system to each module via the individual circuits embedded in the board.

As described, phased array antennas of the prior art utilize a printed wiring board including a plurality of discrete circuit layers embedded therein as a conduit for transmitting information from the antenna control system to the individual phase control modules forming the array. The use of these circuit layers requires each module 12 to include a signal input section 30 through which electrical information provided from an embedded circuit is transferred to phase control circuitry internal to the module (internal circuitry not shown). To accomplish this, a plurality of terminals 32 must be provided on the top surface 20 of printed wiring board 14, each terminal being connected within an individual embedded circuit layer. In order to transfer the electrical information present at each terminal 32 to the phase control circuitry within each module, a plurality of jumper wires 33 are connected between the terminals 32 and a plurality of terminals 34 on signal input section 30. As known in the art, the plurality of terminals and jumpers 32, 33, 34 may be replaced with standard pin and socket connections if desired.

As seen, the use of a printed wiring board such as printed wiring board 14 as a conduit for supplying information from the antenna control system to each of the modules 12 in the array increases the expense of the antenna assembly due to the expense associated with manufacturing the printed wiring board. In addition, the possibility of a module failure due to the loss of an information signal to the module is an ever-present one owing to the nature of mechanical-type connections such as the pin/socket and terminal/jumper wire connections described herein.

In accordance with the present invention, there is provided a phased array antenna which utilizes an assembly for passing various data and power/ground signals from the phased array antenna control system to the individual, phase control modules in the antenna array which eliminates the problems associated with the use of a printed wiring board and mechanical connectors; and is of simple construction to eliminate the expense associated with manufacturing the printing wiring board.

Referring to FIG. 3, there is illustrated an exploded view of a light plane assembly 36 for providing an information transmission path between a phased array antenna control system and the individual phase control modules forming the antenna array. Only a portion of light plane assembly 36 is illustrated in FIG. 3, and it should be understood that light plane assembly 36 has a configuration substantially identical to the configuration of printed wiring board 14 illustrated in FIG. 1. That is, light plane assembly 36 is designed to be positioned within the hollow interior portion of a phased array antenna housing in a manner similar to how printed wiring board 14 is positioned within the hollow interior 24 of housing 16.

Light plane assembly 36 includes a translucent member 38 interposed between a pair of electrically conductive first and second plate members 40, 42 respectively. Translucent member 38 is preferably made from a plexiglass material, but may be made from translucent glass or other suitable material if desired. Translucent member 38 includes a plurality of openings 44 which extend from translucent member top surface 46 to translucent member bottom surface 48. Each of the openings 44 in translucent member 38 defines a generally cylindrical wall portion 50.

First and second plate members 40, 42 are positioned in abutting relation with the top and bottom surfaces 46, 48 of translucent member 38. First and second plate members are made from an electrically conductive material, and as will be explained later in greater detail, form power and ground planes for a plurality of phase control modules inserted into the openings 44 in translucent member 38. Both first and second plate members 40, 42, include a plurality of first and second openings 52, 54 respectively, and the plurality of first and second openings 52, 54 are aligned with the plurality of openings 44 in translucent member 38. Each of the first openings 52 in first plate member 40 defines a generally cylindrical first wall portion 55 having a circumference substantially identical to the circumference of each opening 44. Similarly, each of the second openings 54 in second plate member 42 defines a generally cylindrical second wall portion 56 also having a circumference substantially identical to the circumference of each openings 44. As described, first plate member 40, translucent member 38 and second plate member 42 form a generally laminar assembly having a plurality of aligned sets of openings which extend from the top surface 58 of first plate member 40 to the bottom surface 60 of second plate member 42.

As seen in FIG. 3, each aligned set of openings through translucent member 38 and first and second plate members 40, 42 is adapted to accept a portion of an individual phase control module and radiator assembly generally designated by the numeral 62 (referred to herein as a phase control module). Phase control module 62 illustrated in FIG. 3 includes a body portion 64 which contains internal electronic circuitry openable to adjust the phase of a radar signal passed therethrough. Phase control module 62 further includes optic signal receiving means 66 interposed between a pair of first and second electrical contact elements 68, 70 and a manifold mating end portion 72. Optic signal receiving means 66 is an optic signal detecting and receiving unit, and as will be explained later in greater detail, is operable to detect and receive optic information signals passed through the interior of translucent member 38. With module 62 inserted into an aligned set of openings through translucent member 38 and first and second plate members 40, 42, manifold mating end portion 72 is inserted in the circular portion 74 of an individual manifold opening 76 in manifold plate 78. As known in the art, manifold plate 78 acts as a "transition plate" between rectangular manifold 80 and the generally circular manifold mating end portion 72 of the beam conditioning module 62. As will be explained later in greater detail, first and second electrical contact elements 68, 70, which preferably extend in annular fashion around the body portion of module 62, contact first and second electrically conductive plate members 40, 42 with module 62 inserted in a set of aligned openings. With first and second plate members 40, 42 connected to ground potential and a suitable power source, respectively, the electrical contact elements 68, 70 in contact with the plate members 40, 42 provide operating power and a ground connection to the module internal circuitry.

As further illustrated in FIG. 3, the first cylindrical wall portion 55 of each first opening 52 in first plate member 40 is arranged to form a plurality of integral tab members 80. Each tab member 80 is a resilient member, and has an upturned end portion 82 which engages an outer wall 84 of phase control module 62 with the phase control module positioned in a set of aligned openings through translucent member 38 and first and second plate members 40, 42. This engagement between the tab members 80 end portions 82 and module 62 outer wall 84 provides a means for securing the module in a set of aligned openings.

Light plane assembly 36 further includes light transmitting means generally designated by the numeral 86 preferably formed from a plurality of individual light emitting diodes 88 (one shown) which are positioned in optic communication with the interior 90 of translucent member 38. As seen in FIG. 3, translucent member 38 includes an edge surface 92 which extends between top and bottom surfaces 46, 48. The edge surface 92 of translucent member 38 includes a plurality of openings 94, each opening 94 receiving therein a light emitting diode 88. As will be explained later in greater detail, an electrical information signal provided to the plurality of light emitting diodes 88 is converted by the diodes to an equivalent optic information signal and transmitted through the interior 90 of translucent member 38 to be received by the optic signal receiving means 66 of each phase control module 62. The optic information signal is reconverted within the beam conditioning module to an electrical information signal. Although each diode 88 is preferably inserted in an opening 94 in translucent member 38 edge surface 92, it should be understood that the plurality of diodes utilized may be positioned adjacent to edge surface 92, if desired.

Figure 4:
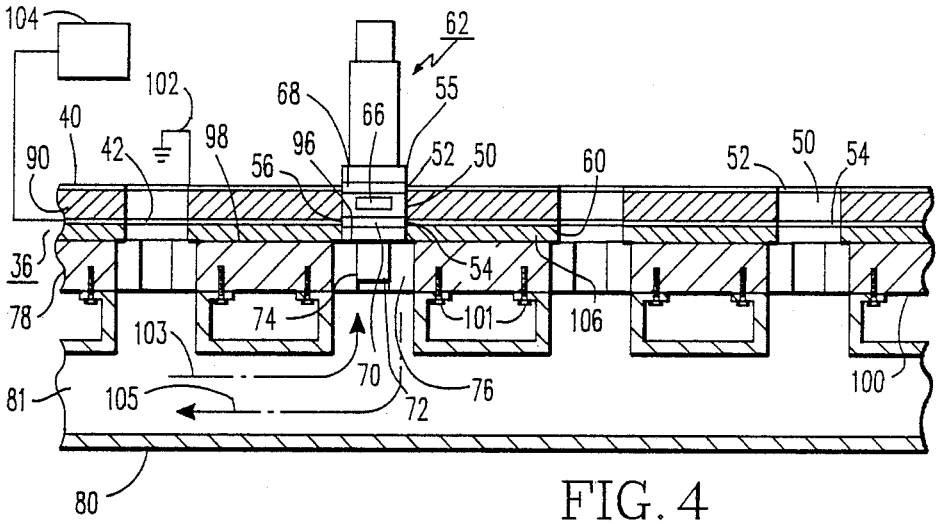
FIG. 4 is a partial sectional view in side elevation of the light plane assembly of the present invention, illustrating a phase control module and radiator assembly connected with the light plane assembly.

Referring now to FIG. 4, there is illustrated a single phase control module 62 positioned in an aligned set of openings 50, 52, 54 in light plane assembly 36. The phase control module 62 is positioned in the aligned set of openings so that a bottom shoulder portion 96 of the module abuts the top surface 98 of manifold plate 78. This permits the generally circular manifold mating end portion 72 of phase control module 62 to extend into the generally circular portion 74 of manifold opening 76 in manifold plate 78. The rectangular manifold 80 previously described is secured to the bottom surface 100 of manifold plate 78 by suitable means such as a plurality of screws 101, and a radar signal may be passed through the hollow interior 81 of manifold 80 and phase control module 62 in a direction indicted by the arrows 103 or 105 depending upon whether the antenna is in a receive or transmit mode.

As seen in FIG. 4, with bottom shoulder portion 96 of phase control module 62 in abutting contact with the top surface 98 of manifold plate 78, the optic signal receiving means 66 of phase control module 62 lies adjacent to the cylindrical wall portion 50 of opening 44 in translucent member 38. With this arrangement, an optic information signal transmitted through the interior 90 of translucent member 38 between translucent member top and bottom surfaces 46, 48 is detected and received by optic signal receiving means 66. Although not specifically illustrated in FIG. 4, it should be understood that a phase control module 62 is inserted in each set of aligned openings in translucent member 38 and first and second plate members 40, 42. The optic information signal transmitted through the interior 90 of translucent member 38 is received by each phase control module in the array. Each phase control module 62 includes internal circuitry (not shown) operable to interpret the data contained in the optic information signal, and utilize that portion of the received data which is applicable to the particular module. It should be understood that the identical optic information signal is transmitted by each diode 88 communicating with the interior 90 of translucent member 38. Thus, each module must be capable of receiving the identical signal and utilizing only that portion of the signal data which is applicable. In order to accomplish this, each phase control module described herein is a "smart" module which is position-programmed to recognize its location within the compliment of modules in the array and determine what portion of the data contained in the optic information signal is applicable to that module. After identifying the portion of the received data applicable to a particular module, the module utilizes the data to calculate an appropriate phase angle setting in order to provide the proper phase shift for a radar signal passed therethrough.

Again referring to FIG. 4, first and second electrical contact elements 68, 70 contact the first and second cylindrical wall portions 55, 56 defined by first and second openings 52, 54 in first and second plate members 40, 42 with phase control module 62 bottom shoulder portion 96 in abutting contact with the top surface 98 of manifold plate 78. As seen in FIG. 4, first plate member 40 is connected with ground potential schematically illustrated and designated by the numeral 102 and second plate member 42 is connected with a power source designated by the numeral 104. With this arrangement, each phase control module 62 in the array of modules is provided with both power and ground connections upon insertion of the module into a set of aligned openings in the translucent member and plate members. Preferably, first plate member 40 is grounded and second plate member 42 is connected with the power source as illustrated in FIG. 4 so that upon initial insertion of a module in a set of aligned openings, the electronic circuitry within the phase control module is grounded through contact between second electrical contact element 70 and first plate member 40 to prevent damage to the module internal circuitry.

As seen in FIGS. 3 and 4, an insulating layer 106 may be positioned in abutting contact with the bottom surface 60 of second plate member 42 if desired to electrically insulate the translucent member 38 and first and second plate members 40, 42 from manifold plate 78 and rectangular manifold 80. If insulating layer 106 is utilized, it should be understood that the insulating layer will include a plurality of openings which are aligned with the sets of openings in translucent member 38 and first and second plate members 40, 42.

Figure 5:
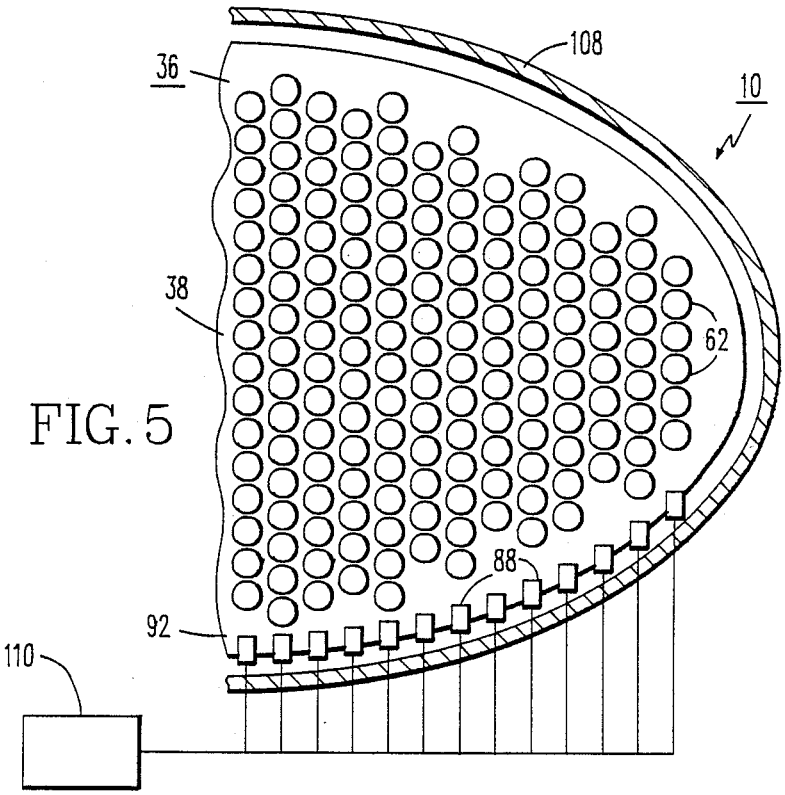
FIG. 5 is a schematic diagram of a portion of a phased array antenna, illustrating a plurality of light emitting diodes connected with a light plane positioned in the antenna housing.

Now referring to FIG. 5, there is schematically illustrated a portion of light plane assembly 36 positioned in a phased array antenna housing 108 similar to housing 16 previously described. As seen in FIG. 5, a plurality of light emitting diodes 88 are embedded in the edge surface 92 of translucent member 38 and positioned to provide that the optic information signal emitted by each diode is received by each module in the array. Each of the light emitting diodes 88 is connected with a phased array antenna control system 110, and an electrical information signal generated by control system 110 is converted by each of the diodes 88 to an equivalent optic information signal. As previously described, each module 62 in the array receives the identical optic information signal, and the "smart" circuitry within each module analyzes the information and selects information applicable only to that module. Depending upon the physical configuration of the antenna array, it should be understood that it may be required to position light emitting diodes 88 around the entire periphery of translucent member 38. If desired, the diodes 88 may be positioned adjacent to edge surface 92 with similar results.

As described, light plane assembly 36 is operable to provide a communication link between a phased array antenna control system and a compliment of phase control modules which form the phased array. The light plane assembly described herein eliminates the need for a printed wiring board and its attendant terminal/jumper wire connections or pin/socket connections. The printed wiring board is replaced with a translucent member, and the combination of diodes and translucent member provides an optic communication link between the phased array antenna control system and the individual modules in the array. It should be understood that although the light plane assembly illustrated and described herein has a generally planar configuration, other light plane configurations may be utilized depending upon the physical design requirements of the antenna.

Although the present invention has been described in terms of what are at present believed to be its preferred embodiments, it will be apparent to those skilled in the art that various changes may be made without departing from the scope of the invention. It is therefore intended that the appended claims cover such changes.

We claim:

1. A light plane assembly for passing an information signal provided from a phased array antenna control system to a plurality of individual phase control modules forming the antenna array comprising:

a translucent member for placement within a phased array antenna housing;

said translucent member having a plurality of openings therethrough, each of said openings adapted to receive at least a portion of a phase control module having optic signal receiving means thereon;

light transmitting means positioned in optic communication with said translucent member and connected with said phased array antenna control system, said light transmitting means being operable to convert an electrical information signal provided from said antenna control system to an equivalent optic information signal;

said light transmitting means providing said optic information signal to said translucent member for transmission through an interior portion of said translucent member; and said optic information signal transmitted through said translucent member interior portion being received by said phase control module optic signal receiving means.

2. The light plane assembly of claim 1 in which:

said light transmitting means in communication with said translucent member includes a plurality of light emitting diodes;

each said phase control module optic signal receiving means is a light detecting and receiving unit; and one said phase control module is positioned in each said opening with said light detecting unit of said module received within said opening to provide that said optic information signal produced by said plurality of light emitting diodes and transmitted through said interior portion of said translucent member is received by said light receiving unit.

3. The light plane assembly of claim 2 in which:

each of said openings through said translucent member defines a translucent member wall portion; and at least a portion of one said phase control module is positioned in one of said openings so that said light detecting unit of said module is positioned adjacent to said wall portion.

4. The light plane assembly of claim 2 in which:

each said phase control module positioned in an opening in said translucent member is operable to pass a radar signal therethrough;

said optic information signal provided by said light transmitting means is transmitted through said interior portion of said translucent member and received by said optic signal receiving means of said phase control module; and each said phase control module is operable in response to said received optic information signal to control the phase of said radar signal passed therethrough.

5. The light plane assembly of claim 2, wherein said translucent member is made from a plexiglass material having a generally planar configuration.

6. The light plane assembly of claim 2, wherein said translucent member is made from a glass material having a generally planar configuration.

7. A light plane assembly for passing an information signal provided from a phased array antenna control system to a plurality of individual phase control modules forming the antenna array comprising:

a translucent member for placement within a phased array antenna housing;

said translucent member having a first surface, a second surface opposed to said first surface, an edge surface extending between said first and second surfaces, and a plurality of openings extending through said translucent member from said first to said second surface, each of said openings defining a wall portion between said first and second surfaces;

each of said openings adapted to receive at least a portion of a phase control module having optic signal receiving means thereon so that said optic signal receiving means is positioned adjacent to said opening wall portion;

light transmitting means positioned in optic communication with said translucent member edge surface, said light transmitting means being connected with said phased array antenna control system and operable to convert an electrical information signal provided from said control system to an equivalent optic information signal;

said light transmitting means providing said optic information signal to said translucent member at said edge surface for transmission through said translucent member between said first and second surfaces; and said optic information signal transmitted through said translucent member between said first and second surfaces being received by each said phase control module optic signal receiving means positioned in an opening adjacent to said opening wall portion.

8. The light plane assembly of claim 7 which includes:

a first plate member in abutting contact with said first surface of said translucent member, said first plate member having a plurality of first openings therethrough, each of said plurality of first openings defining a first wall portion in said first plate member;

a second plate member in abutting contact with said second surface of said translucent member, said second plate member having a plurality of second openings: therethrough, each of said plurality of second openings defining a second wall portion in said second plate member;

said first plate member, translucent member and second plate member adapted to be positioned in said phased array antenna housing; and said plurality of first openings in said first plate member, said plurality of openings in said translucent member and said plurality of second openings in said second plate member being aligned with each other to provide a plurality of aligned sets of openings for receiving said plurality of pulse control modules.

9. The light plane assembly of claim 8 in which:

each said phase control module includes first and second electrical contact elements positioned on an outer wall of said module;

said optic signal receiving means of said module is interposed between said first and second electrical contact elements; and at least a portion of one said phase control module is positioned in one of said sets of aligned openings to provide that said first electrical contact element of said module contacts a first wall portion of a first plate member first opening and said second electrical contact element contacts a second wall portion of a second plate member second opening.

10. The light plane assembly of claim 9 in which:

said first electrical contact element is a ground connecting terminal and said second electrical contact element is a power input terminal;

said first plate member is at ground potential and said second plate member is connected with a power source; and said power input and ground connecting terminals of a phase control module are connected with said power source and ground potential, respectively, with said phase control module positioned in one of said aligned sets of openings to thereby provide a power and a ground potential connection to said module.

11. The light plane assembly of claim 9, in which:

said first and second electrical contact elements each have a generally annular configuration for extending around said outer wall of said module.

12. The light plane assembly of claim 8 which includes:

insulating means disposed between said second plate member and said manifold assembly for electrically insulating said first plate member, translucent member and second plate member from said manifold assembly.

13. The light plate assembly of claim 8 in which:

each said first wall portion defined by a first plate member first opening is formed from a plurality of tab means integral with said first plate member, said plurality of tab means arranged to engage an outer wall portion of a phase control module with said module positioned in one of said aligned sets of openings to maintain said module in said openings.

14. The light plane assembly of claim 7 in which:

said light transmitting means includes a plurality of light emitting diodes in optic communication with said translucent member edge surface;

said phase control module optic signal receiving means is a light receiving unit; and one said phase control module is positioned in said opening in said translucent member with said optic signal receiving means of said module located within said opening adjacent said wall portion to provide that said optic information signal produced by said plurality of light emitting diodes and transmitted through said translucent member between said first and second surfaces is received by said module optic signal receiving means.

15. The light plane assembly of claim 14 in which:

said plurality of light emitting diodes are embedded in said translucent member edge surface.

16. The light plane assembly of claim 14 in which:

said plurality of light emitting diodes are positioned adjacent to said translucent member edge surface.

17. The light plate assembly of claim 7 in which:

each of said plurality of phase control modules positioned in an opening in said translucent member is operable to pass a radar signal therethrough;

said optic information signal provided by said light transmitting means is transmitted through said translucent member between said first and second surfaces and received by said optic signal receiving means on each said phase control module; and each of said phase control modules is operable in response to said received optic information signal to control the phase of said radar signal passed therethrough.

18. The light plane assembly of claim 7 in which:

said translucent member is formed from a generally planar sheet of plexiglass material.

19. The light plane assembly of claim 7 in which:

said translucent member is formed from a generally planar sheet of glass.

* * * * *